United States Patent [19]

Feng

[11] 4,219,316

[45] Aug. 26, 1980

[54] CURVED SPIRAL PUMP

[76] Inventor: Chung L. Feng, 16 Seven Springs Rd., Radnor, Pa. 19087

[21] Appl. No.: 913,008

[22] Filed: Jun. 5, 1978

[51] Int. Cl.[3] ..... F01C 5/02; F01C 21/08; F04C 5/00; F04C 29/00

[52] U.S. Cl. ..... 418/153; 418/220; 415/72

[58] Field of Search ..... 418/153, 220, 45; 415/71, 72; 73/253; 198/659, 661

[56] References Cited

U.S. PATENT DOCUMENTS

| | | | |
|---|---|---|---|
| 1,711,193 | 4/1929 | Wunderlich | 415/72 |
| 2,045,757 | 6/1936 | Constantin | 415/72 |
| 2,505,125 | 4/1950 | List | 415/72 |
| 2,695,694 | 11/1954 | Seinfeld | 418/153 |
| 3,307,683 | 3/1967 | Pleasants | 415/72 |
| 3,360,108 | 12/1967 | Voss | 198/659 |
| 3,951,576 | 4/1976 | Lofquist, Jr. | 418/153 |

FOREIGN PATENT DOCUMENTS

| | | | |
|---|---|---|---|
| 1943726 | 3/1971 | Fed. Rep. of Germany | 418/153 |

*Primary Examiner*—John J. Vrablik

[57] ABSTRACT

A pumping or compressing geometry is being disclosed. Several turns of deformable spiral are fitted in a curved housing to form line contacts between turns of the spiral by allowing it to bend. These line contacts separate the inlet and the outlet ports in a pump or form the compressing chamber in a compressor.

4 Claims, 8 Drawing Figures

CURVED SPIRAL PUMP

SUMMARY

One type of positive displacement pump which utilizes the properties of deformable materials is the pinched tube pump. The pinched tube pump requires two or more rollers to function and is therefore complicated and bulky. The pumping geometry of this disclosure also utilizes deformable materials but basically needs only two parts, housing and impeller, with rotation to form moving chambers.

The impeller is formed as a one piece deformable spiral. The spiral is like a cork screw with triangular or trapizoid cross sections instead of the usual round cross section. The impeller is fitted in a curved tubular housing. The curvature of the housing causes the axis of the spiral to bend. This bending increases the distance between turns of the spiral on one side and diminishes the distance between turns on the other until the formation of a line contact. When the axis of the spiral is straight the void between turns form a continuous space. When the axis is bent the continuous space is interupted at the line contacts and forms seperated chambers. These chambers move along the axis as the spiral impeller is rotated relative to the housing about the axis. Like most pumping geometry it may also be used in fluid motors and volumetric measuring devices.

DRAWINGS AND DESCRIPTION

FIG. 2 is basically formed by bending FIG. 1 in the plane of the paper.

Figure 1:
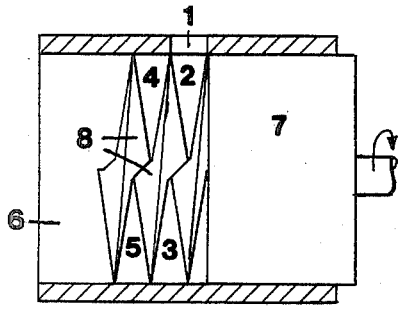
FIG. 1 shows a spiral impeller, in an as fabricated condition of one embodiment, inside a straight, cylindrical and sectioned housing.
Figure 2:
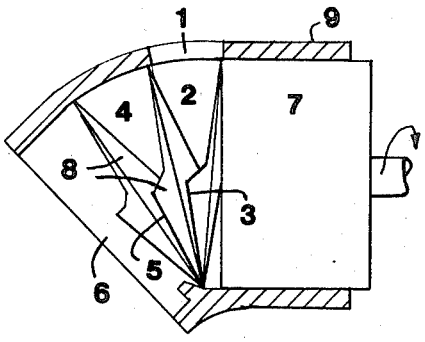
FIG. 2 shows the same impeller but in a curved housing.

A positive displacement curved spiral pump is shown in FIG. 2. The spiral impeller is bent from the free condition of FIG. 1. In FIG. 1 the inlet port 1 is connected through the spiral voids 2, 3, 4, 5 to the outlet port 6. The impeller has a body 7 and several turns of spiral 8. Since the inlet and the outlet ports are connected the rotation of the impeller will not cause any pumping action. The same impeller with body 7 and spiral 8 is fitted in a curved housing 9 in FIG. 2. The curved housing forces the spiral to bend and the impeller makes line contacts at 3 and 5 between spiral turns. These line contacts seperate the void 2 and 4 into disconnected chambers. If the impeller is rotated clockwise as viewed from the end of body 7, the disconnected chambers 2 and 4 will advance towards the outlet port 6. The line contacts at 3 and 5 will also advance as the impeller rotates. For the embodiment as shown in FIG. 2 the line contact ends at line contact 5. If the impeller rotates clockwise line contact at 5 will cease to exist and chamber 4 will then be connected to outlet port 6. Since inlet port 1 is then still connected to chamber 2, the inlet port 1 and outlet port 6 are only seperated by the line contact at 3. For pumping action the number of spiral turns needed is to have at least one seperating line contact at all times.

Figure 3:
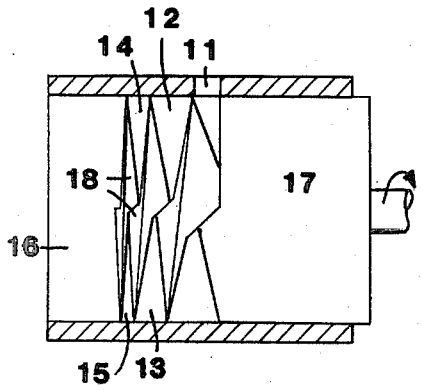
FIGS. 3 and 4 show the same views as FIGS. 1 and 2 except the spiral impeller has a varying pitch.
Figure 4:
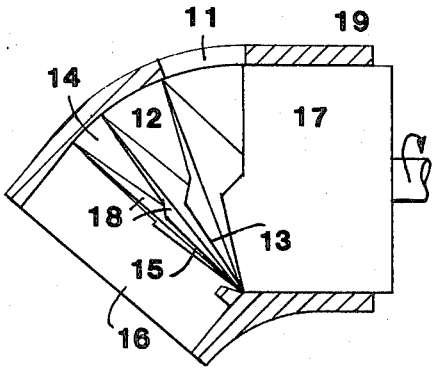

Two line contacts are required to form a closed compression chamber for the compressor function. The chamber compresses the trapped gases by reducing its volume. The chamber is to reach the compressed pressure before it is connected to the outlet port. In this manner flow back into the chamber is avoided. Flowback is a source of vibration and noise as well as heat generation and inefficiency. The compression chamber is formed by having enough spiral turns with varying pitch. FIG. 3 shows the increasing pitch spiral with an extra turn more than the spiral of FIG. 1. In FIG. 3 the voids 12, 13, 14, 15 are still connected. In FIG. 4 the spiral turns 18 have a bent axis. This causes the turns to make line contacts at 13 and 15. Both spaces 12 and 14 of FIG. 4 are trapped spaces not connected to either the inlet 11 or the outlet 16. The number of spiral turns needed is to have at least one closed chamber at all times. If a clockwise rotation of the impeller as viewed from the end of body 17 is considered, it is clear that space 12 was connected to the inlet port 11 earlier and space 14 will be connected to the outlet port 16 later. As the rotation continues space 12 will be the closed chamber isolated by the line contacts at 13 and 15 until it takes up the present position of space 14 and conneets to the outlet port afterwards. When space 12 reaches the present position of space 14 the chamber that was connected to the inlet port will be at the present position of space 12. It is also clear that the volume of space 12 is greater than space 14. Therefore as space 12 moves forward its volume continuously reduces and comresses the contained gases.

Figure 5:
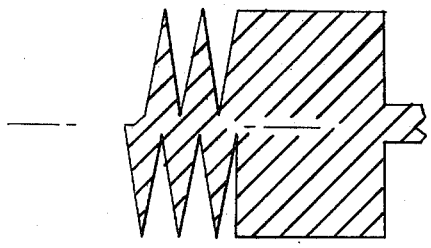
FIG. 5 shows a cross-section view of the impeller of FIG. 1. The voids of the spiral are shown to the same radial dimension as FIG. 1.
Figure 6:
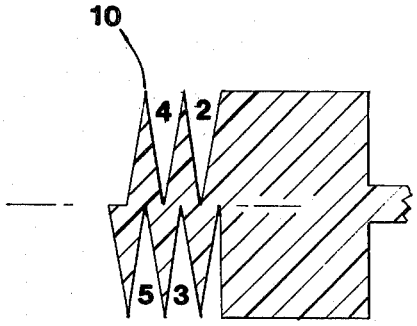
FIG. 6 is a view similar to FIG. 5 except the voids of the spiral are shown at the maximum possible radial dimension reaching the centerline. This view makes it easy to visualize, with minimum material distortion caused by bending, the string of centers of rotation forming a centerline.
Figure 7:
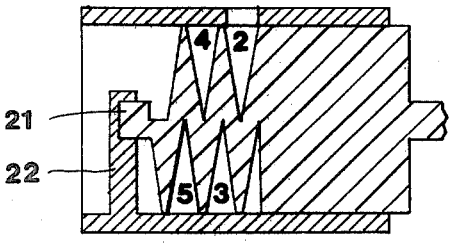
FIGS. 7 and 8 show again the basic views of FIGS. 1 and 2 except the impeller, having substantially the same shape as the impeller of FIG. 6, is smaller in diameter and therefore shows a trapezoidal cross-section for the turns of the spiral.
Figure 8:
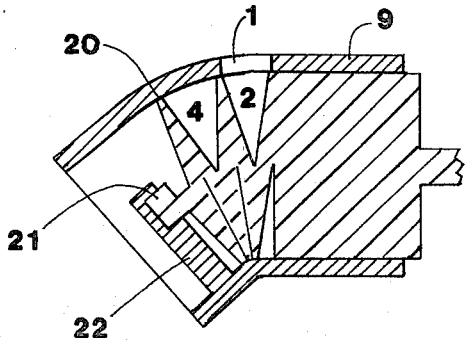

FIG. 6 shows the voids between the turns of the spiral, 2, 3, 4 and 5, reaching the centerline instead of the exaggerated general condition shown in FIG. 5. The spiral of FIG. 6 will need less material stretching or compression when it bends to fit a curved housing. The rim 10 of a spiral turn rotates about a point on the centerline a fixed distance, radius, away. Different rim points all have circular trajectory although each rotates around a different center point. The housing can be made to have a circular cross-section in any plane perpendicular to the centerline. The result is for points on the rim to contact circular tracks on the housing. This is also a line contact but it is different from the radial line contact between turns of a spiral. Fluid is prevented from leaking around the rim 10 because the rim is in contact with the housing. FIG. 8 shows a configuration with the trapezoidal cross-section. The flat rim 20, if sufficiently rigid, can only touch the housing with a circular cross-section at one point. If this point is the center of the rim flat 20, and sliding contact is made with the housing on the lower, sharply bent, housing wall, then the corners of the rim flat will interfere the most with the upper curve of the housing wall. If the circular housing is made slightly larger and sliding contact made at the upper wall, then the fluid can leak the most around the rim at the lower wall. If the trapezoidal cross-section is used then either the material should be resilient or the housing should have noncircular cross-sections. The trapezoidal spiral also requires end support shown as stub shaft 21 and support arm 22. The triangular spirals only need a sharp corner for a stop because the rims of a spiral come to one point.

The curved spiral pump and compressor can also be used as fluid motors and measuring devices. If fluid at high pressure forces its way from outlets 6 or 16 to inlets 1 or 11 the impeller will be forced to rotate with respect to the housing. This action of converting fluid power of pressure and flow to mechanical power of torque and rotation reverses the pumping action of converting from mechanical power to fluid power. Since the pumping action is positive displacement it is also usable as a fluid flow measuring device, using the rotation of the impeller as an indication of fluid flow.

Although the present invention has been described in reference to specific embodiments, there are many equivalents that may be substituted for the specific elements shown and described, and there are features which may be used independently of other features, to form embodiments still within the scope and spirit of this invention as defined in the appended claims.

I claim:

1. A fluid pump comprising a curved housing with inlet and outlet ports, a spiral impeller, inside of and with periphery substantially in contact with said housing, bent to the housing curvature to form substantially line contacts between spiral turns, forming chambers confined by spiral turns, their line contacts, and wall of housing and preventing direct communication between inlet and outlet ports, and means to rotate said impeller to advance said chambers from being connected to the inlet port through isolation to being connected to the output port.

2. A compressor comprising a curved housing with inlet and outlet ports, a varying pitch spiral impeller, inside of and with periphery substantially in contact with said housing, bent to the housing curvature to form substantially line contacts between spiral turns, forming chambers confined by spiral turns, their line contacts, and wall of housing and preventing direct communication between inlet and outlet ports, and means to rotate said impeller to advance and contract said chambers from being connected to the inlet port through isolation and compression to being connected to the outlet port.

3. A fluid motor comprising a curved housing with inlet and outlet ports, a constant or varying pitch spiral impeller, inside of and with periphery substantially in contact with said housing, bent to the housing curvature to form substantially line contacts between spiral turns, forming chambers confined by spiral turns, their line contacts, and wall of housing and preventing direct communication between inlet and outlet ports, and means to output mechanical power from said impeller which is forced to rotate by fluid flowing through motor.

4. A volumetric measuring device comprising a curved housing with inlet and outlet ports, a spiral impeller, inside of and with periphery substantially in contact with said housing, bent to the housing curvature to form substantially line contacts between spiral turns, forming chambers confined by spiral turns, their line contacts, and wall of housing and preventing direct communication between inlet and outlet ports, and means to register rotation of said impeller as an indication of fluid flow.

* * * * *